US007988801B2

(12) United States Patent
Shortridge et al.

(10) Patent No.: US 7,988,801 B2
(45) Date of Patent: Aug. 2, 2011

(54) PERCHLORATE-FREE GREEN SIGNAL FLARE COMPOSITION

(75) Inventors: Robert G. Shortridge, Bloomington, IN (US); Christina M. Yamamoto, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 494 days.

(21) Appl. No.: 12/334,096

(22) Filed: Dec. 12, 2008

(65) Prior Publication Data

US 2009/0320975 A1 Dec. 31, 2009

Related U.S. Application Data

(60) Provisional application No. 61/075,647, filed on Jun. 25, 2008.

(51) Int. Cl.
*C06B 43/00* (2006.01)
*C06B 33/00* (2006.01)
*C06B 31/00* (2006.01)

(52) U.S. Cl. ..... 149/37; 149/22; 149/45; 149/109.6

(58) Field of Classification Search ..... 149/20, 149/22, 37, 45, 109.6
See application file for complete search history.

(56) References Cited

U.S. PATENT DOCUMENTS

| | | | |
|---|---|---|---|
| 2,362,502 | A | 11/1944 | Schladt |
| 3,411,963 | A | 11/1968 | Douda |
| 3,499,385 | A | 3/1970 | Douda |
| 3,690,572 | A | 9/1972 | Thumm et al. |
| 3,690,972 | A | 9/1972 | Kaye et al. |
| 3,911,823 | A | 10/1975 | Murray et al. |
| 3,954,529 | A | 5/1976 | Reed et al. |
| 3,983,816 | A | 10/1976 | Cornia et al. |
| 4,078,954 | A | 3/1978 | Bernardy |
| 4,164,186 | A | 8/1979 | Beatty et al. |
| 4,184,901 | A | 1/1980 | Tanner, Jr. et al. |
| 4,204,895 | A | 5/1980 | Webster, III |
| 4,341,573 | A | 7/1982 | Donoho |
| 4,768,439 | A | 9/1988 | Singer et al. |
| 4,812,180 | A | 3/1989 | Sayles |
| 5,056,435 | A | 10/1991 | Jones et al. |
| 5,071,497 | A | 12/1991 | Hassell et al. |
| 5,561,260 | A | 10/1996 | Towning et al. |
| 5,565,150 | A | 10/1996 | Dillehay et al. |
| 5,585,594 | A | 12/1996 | Pelham et al. |
| 5,917,146 | A | 6/1999 | Hiskey et al. |
| 6,092,467 | A | 7/2000 | Brice |
| 6,174,391 | B1 | 1/2001 | Chen et al. |

(Continued)

FOREIGN PATENT DOCUMENTS

DE 10 2005 053849 A1 5/2007

(Continued)

OTHER PUBLICATIONS

Webster, Henry A, "Visible Spectra of Standard Navy Colored Flares" Propellants, Explosives, Pyrotechnics, Feb. 1985, vol. 10, No. 1, Feb. 1985.

(Continued)

*Primary Examiner* — Aileen B Felton
(74) *Attorney, Agent, or Firm* — Christopher A. Monsey

(57) ABSTRACT

Perchlorate-free green flare compositions are disclosed which, when burned, produce green smoke and flames. Methods of producing the compositions are also disclosed.

20 Claims, 3 Drawing Sheets

U.S. PATENT DOCUMENTS

| | | | |
|---|---|---|---|
| 6,214,139 | B1 | 4/2001 | Hiskey et al. |
| 6,263,797 | B1 | 7/2001 | Brice |
| 6,312,537 | B1 | 11/2001 | Hiskey et al. |
| 6,312,625 | B1 | 11/2001 | Nielson et al. |
| 6,315,847 | B1 | 11/2001 | Lee et al. |
| 6,432,231 | B1 | 8/2002 | Nielson et al. |
| 6,530,327 | B2 | 3/2003 | Hiskey et al. |
| 6,599,379 | B2 | 7/2003 | Hiskey et al. |
| 2002/0148540 | A1 | 10/2002 | Hiskey et al. |
| 2007/0068610 | A1 | 3/2007 | Nickel |

FOREIGN PATENT DOCUMENTS

| | | |
|---|---|---|
| GB | 1520601 A | 8/1978 |
| GB | 2044748 | 10/1980 |
| WO | WO 00/44689 | 8/2000 |

OTHER PUBLICATIONS

Wilkin, R T et al, "Perchlorate behavior in a municipal lake following fireworks displays" Environmental Science and Technology, American Chemical Society. Easton, PA, US, vol. 41, No. 11, Jun. 1, 2007.

International Search Report and Written Opinion for PCT Application No. PCT/US2009/048586 issued by the International Search Authority on Mar. 1, 2010.

Shortridge et al., Elimination of Perchlorate Oxidizers from Pyrotechnic Flare Compositions, Final Technical Report WP-1280, authorized for public release on or after Apr. 24, 2008, 65 pgs. Crane, Indiana.

Shortridge, Robert, Elimination of Perchlorate Oxidizers From Pyrotechnic Flare Compositions, Weapons Systems and Platforms WP-1280, Nov. 2006, 1 pg., Crane, Indiana.

Webster, et al., Flares Containing Calcium Nitrate as an Oxidizer, U.S. Department of Commerce, National Technical Information Service, May 31, 1976, 40 pgs, Crane, Indiana.

Conkling, John A., Chemistry of Pyrotechnics, Basic Principles and Theory, 1985, Marcel Dekker, Inc., 85 pgs. New York, New York.

Halford, Bethany, Pyrotechnics for the Planet—Chemists Seek Environmentally Friendlier Compounds and Formulations for Fireworks and Flares, Chemical & Engineering News, Jun. 30, 2008, pp. 14-18, vol. 86, No. 26.

Smith, Tom, "Assessing the Risks—Suggestions for a Consistent Semi-Quantified Approach", Journal of Pyrotechnic, Winter 2003, 11 pgs.

Shortridge et al, Elimination of Perchlorate Oxidizers from Pyrotechnic Flare Compositions, ESTCP 07E-WP3-021, Navsea Warfare Centers, Dec. 2007, 1 pg., Crane, Indiana.

Shortridge et al. Development and Testing of Perchlorate-Free Red and Green Pyrotechnic Flare Compositions, Department of Mechanical Engineering, New Jersey Institute of Technology, Newark NJ, Jul. 16, 2006, 10 pgs., Crane, Indiana.

PERCHLORATE-FREE GREEN SIGNAL FLARE COMPOSITION

CROSS-REFERENCE TO RELATED APPLICATIONS

This application claims the benefit of U.S. Provisional Application No. 61/075,647, filed Jun. 25, 2008, which is hereby expressly incorporated by reference. This application also expressly incorporates by reference co-filed U.S. non-provisional patent applications titled "PERCHLORATE-FREE RED SIGNAL FLARE COMPOSITION," 12/334,103, and "PERCHLORATE-FREE YELLOW SIGNAL FLARE COMPOSITION," 12/334,101, filed on the same day as this application.

STATEMENT REGARDING FEDERALLY SPONSORED RESEARCH OR DEVELOPMENT

The invention described herein was made in the performance of official duties by an employee of the Department of the Navy and may be manufactured, used, licensed by or for the United States Government for any governmental purpose without payment of any royalties thereon.

BACKGROUND

The present disclosure relates to approaches for reformulating green pyrotechnic compositions so as to eliminate environmentally objectionable perchlorate ingredients while still providing acceptable performance when compared to in-service signal flare devices.

Pyrotechnics are used in a variety of applications. One such application is colored signal flares. Many such pyrotechnic flare compositions include chlorate or perchlorate oxidizers. Residual perchlorates from these devices may be absorbed into groundwater and require remediation.

In the past, the vast majority of red, green and yellow signal flares have used perchlorate ingredients to produce their desired colors. This has contributed to an increase in the total concentration of perchlorate residues at various sites, such as military and industrial sites, and to their generally higher than desired concentration in drinking water supplies. Clearly, any methods that can be used to eliminate the perchlorates and minimize any other chlorine-containing ingredients would be an environmentally noteworthy advance in the state of the art.

The U.S. Navy has an in-service green flare perchlorate-containing composition (IS G). IS G includes approximately twenty-one weight percent (21%) Granulation 18 magnesium fuel, approximately seven weight percent (7%) copper, approximately thirty-two point five weight percent (32.5%) potassium perchlorate, approximately twenty-two point five weight percent (22.5%) barium nitrate, approximately twelve weight percent (12%) polyvinyl chloride (PVC), and approximately five weight percent (5%) binder. The binder including the range of approximately seventy percent (70%) to approximately eighty percent (80%) Epon™ Resin 813 epoxy and within the range of approximately twenty percent (20%) to approximately thirty percent (30%) Versamid® 140 curing agent. Accordingly, it was this composition that formed the starting point in the new perchlorate-free green signal flare formulations disclosed in the present patent application.

SUMMARY

The present disclosure includes a flare composition for producing a green flame, the composition comprising, by weight, a magnesium fuel within the range of approximately ten percent (10%) to approximately thirty percent (30%) of the composition, the magnesium fuel including particles sizes selected from the group consisting of granulation 15, granulation 17, granulation 18, and mixtures thereof, a sub-micron amorphous boron fuel making up to approximately five percent (5%) of the composition, a powdered copper fuel making up to approximately ten percent (10%) of the composition, a barium nitrate oxidizer within the range of approximately fifty percent (50%) to approximately sixty-five percent (65%) of the composition, a polyvinyl chloride color enhancer within the range of approximately six percent (6%) to approximately twelve percent (12%) of the composition, and a two-part curable binder system within the range of approximately four percent (4%) to approximately seven point five percent (7.5%) of the composition, the binder system including within the range of approximately seventy percent (70%) to approximately eighty percent (80%) epoxy and within the range of approximately twenty percent (20%) to approximately thirty percent (30%) curing agent.

The present disclosure also includes a method of producing a flare composition, the method comprising the steps of: mixing magnesium within the range of approximately ten weight percent (10%) to approximately thirty weight percent (30%) of the composition, amorphous boron making up to approximately five weight percent (5%) of the composition, copper making up to approximately ten weight percent (10%) of the. composition, and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof wherein the binder system includes the range of approximately seventy percent (70%) to approximately eighty percent (80%) epoxy and within the range of approximately twenty percent (20%) to approximately thirty percent (30%) curing agent, blending barium nitrate within the range of approximately fifty percent (50%) to approximately sixty-five weight percent (65%) of the composition and polyvinyl chloride within the range of approximately six weight percent (6%) to approximately twelve weight percent (12%) of the composition, mixing the barium nitrate and polyvinyl chloride blend to the binder system coated magnesium, boron, and copper mixture in a mixing bowl to provide the composition, and wiping the sides of the mixing bowl, screening the composition, aging the composition for a period of time, and pressing the composition into the flare composition.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
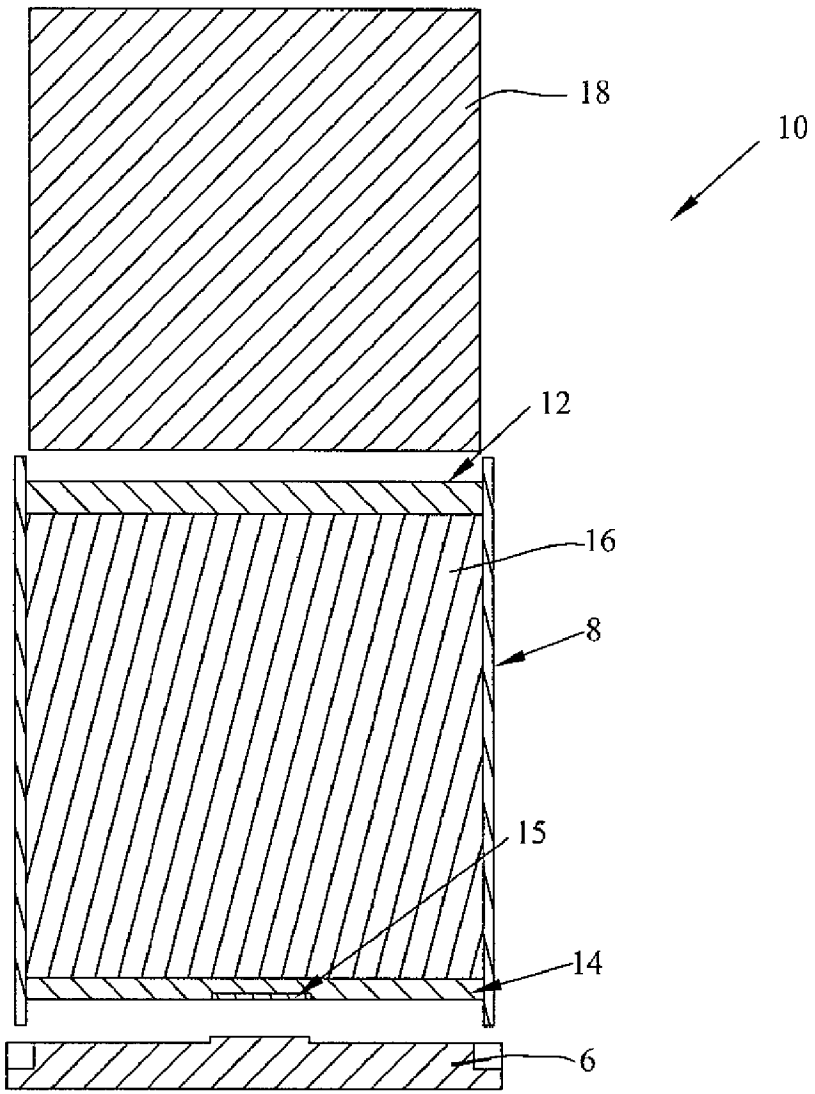
FIG. 1 is a schematic illustration of an illustrative embodiment of a signal flare in an inverted orientation for pressing by a ram.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

In the present disclosure, perchlorate oxidizers currently used in various in-service flare compositions are substituted with nitrate or other less energetic oxidizers. Because these oxidizers are less reactive than those that include perchlorate, high-energy fuels are used to make up for the loss in energy.

Specifically, compositions and method are disclosed in which perchlorate-free pyrotechnic compositions are prepared for use as linear burning, 0.75-inch diameter, free-standing laboratory scale green signal flare candles. It is intended that these perchlorate-free flare candles be prepared in such a way to produce either equal or superior luminous intensities, burn times, dominant wavelengths, and color purities when compared with the in-service perchlorate-containing compositions.

Numerous perchlorate-free green flare compositions of the present disclosure are mixed, pressed and function tested at laboratory scale. The compositions may be initially pressed into laboratory scale pellets in order to fine tune the burn rates and luminous intensity output. Compositions may then be scaled to concept scale green flare candles, such as 1.2-inch diameter linear burning prototype scale green flare candles pressed into fish paper tubes 8 (FIG. 1).

As shown in FIG. 1, flare candle 10 includes a bottom layer of approximately 3 to approximately 5 grams of inert fireclay composition 12, and a top layer of approximately 2.5 grams of ignition composition 14, on top of which ignition slurry 15 is painted in order to aid in ignition transfer. Typically inert fireclay composition 12 is a separate composition for safety purposes and for thermal insulation to prevent flare candle 10 from igniting any smoke portion created during operation of flare candle 10. Ignition composition 14 is added as a top layer to assist in ignition of flare candle 10.

As discussed in greater detail below, flare candle 10 also includes perchlorate-free pyrotechnic composition 16. To enhance the safety of the pellet pressing operation, candle 10 is pressed in an upside down orientation so that moving upper ram 18 comes in direct contact only with the inert fireclay composition layer 12 and that base of press 6 comes in to contact with ignition composition 14. Pressed candles 10 are then subjected to performance testing in a photometric tunnel. Candles 10 are illustratively tested in an upside down orientation with a 12-14 mph airflow in order to aid in smoke removal. Candles 10 may then be subjected to the same flare performance testing as were the Navy's Green signal flare perchlorate-containing green standard composition.

The perchlorate-free green flare compositions of the present disclosure may not include either the hygroscopic calcium nitrate or the environmentally objectionable potassium perchlorate ingredients. The perchlorate-free green flare compositions of the present disclosure include three pyrotechnic fuels. More specifically, the perchlorate-free green flare compositions of the present disclosure include from approximately 10% to approximately 30% of magnesium fuel which may be any one of or combination of Granulation 15 (GR 15), Granulation 17 (GR 17) and Granulation 18 (GR 18). Materials including magnesium are known to take several forms, such as powder, atomized, and amorphous flakes. In one embodiment of the present disclosure, the magnesium source is atomized.

In Table 1, granulation numbers 15, 17, and 18, among others, are described in greater detail. In Table 2, granulation requirements for granulation numbers 15, 17, and 18, among others, are described in greater detail. Tables 1 and 2 are from the American Society for Testing and Materials document MIL-DTL-382D, the subject matter of which is expressly incorporated by reference.

TABLE 1

American Society for Testing and Materials (ASTM) Granulation Numbers

| Granulation Number | Nominal Mesh Size Metric | Nominal Mesh Size U.S. |
|---|---|---|
| 1 | 425 μm-180 μm | 40-80 |
| 2 | 425 μm-180 μm | 40-80 (alternate) |
| 3 | 300 μm-150 μm | 50-100 |
| 4 | 300 μm-150 μm | 50-100 (Army) |
| 5 | 300 μm-125 μm | 50-120 |
| 6 | 180 μm-125 μm | 80-120 |
| 7 | 150 μm | 100 |
| 8 | 125 μm-75 μm | 120-200 |
| 9 | 106 μm | 140 |
| 10 | 75 μm | 200 |
| 11 | 180 μm-75 μm | 80-200 |
| 12 | 125 μm-75 μm | 120-200 (Army) |
| 13 | 850 μm-300 μm | 20-50 |
| 14 | 300 μm-150 μm | 50-100 |
| 15 | 150 μm-75 μm | 100-200 |
| 16 | 75 μm-45 μm | 200-325 |
| 17 | 300 μm-150 μm | 50-100 |
| 18 | 600 μm-300 μm | 30-50 |

TABLE 2

American Society for Testing and Materials (ASTM) Granulation requirements[1].

| Granulation | Max Sieve Metric (U.S.) | Percent Pass | Min Sieve Metric (U.S.) | Percent Pass | Density[2] (gm/ml) Max | Density[2] (gm/ml) Min |
|---|---|---|---|---|---|---|
| 1 | 600 μm (No. 30) | 100% | 180 μm (No. 80) | 15% | 0.65 | 0.55 |
| 2 | 300 μm (No. 50) | 90% | 180 μm (No. 80) | 5% | 0.65 | 0.55 |
| 3 | 600 μm (No. 30) | 10% | 150 μm (No. 100) | 15% | 0.75 | 0.65 |
| 4 | 850 μm (No. 20) | 100% | 150 μm (No. 100) | 12% | 0.625 | 0.45 |
| 5 | 425 μm (No. 40) | 100% | 125 μm (No. 120) | 10% | — | — |
| 6 | 212 μm (No. 70) | 100% | 125 μm (No. 120) | 10% | — | — |
| 7 | 150 μm (No. 100) | 98% | — | — | — | — |

TABLE 2-continued

American Society for Testing and Materials (ASTM) Granulation requirements[1].

| Granulation | Max Sieve Metric (U.S.) | Percent Pass | Min Sieve Metric (U.S.) | Percent Pass | Density[2] (gm/ml) Max | Min |
|---|---|---|---|---|---|---|
| 8 | 250 μm (No. 60) | 100% | 75 μm (No. 200) | 10% | — | — |
| 9 | 125 μm (No. 120) | 98% | 75 μm (No. 200) | 0% | — | — |
| 10 | 125 μm (No. 120) | 100% | 75 μm (No. 200) | 90-100% | — | — |
| 11 | 710 μm (No. 25) | 100% | 75 μm (No. 200) | 25% | — | — |
| 12 | 150 μm (No. 100) | 100% | 75 μm (No. 200) | 85% | — | 0.45 |
| 13 | 3.35 mm (No. 6) | 100% | 300 μm (No. 50) | 5% | — | 0.45 |
| 14 | 300 μm (No. 50) | 90% | 150 μm (No. 100) | 15% | — | 0.70 |
| 15 | 300 μm (No. 50) | 100% | 75 μm (No. 200) | 15% | 0.75 | 0.65 |
| 16 | 75 μm (No. 200) | 96% | 4 μm (—) | 0% | — | 0.62 |
| 17 | 600 μm (No. 30) | 100% | 150 μm (No. 100) | 15% | — | 0.90 |
| 18 | 1.18 mm (No. 16) | 99% | 212 μm (No. 70) | 1% | — | 0.90 |

[1]All percentages shall be by weight using sieves conforming to ASTM E 11, "Standard Specification for Wire-Cloth Sieves for Testing Purposes." The powder shall pass through the required sieves readily without balling or the particles clinging together.
[2]Density of the magnesium powder is determined in accordance with ASTM B 329, "Standard Test Method for Apparent Density of Refractory Metals and Compounds by the Scott Volumeter."

MIL-DTL-382D describes the process for measuring the granulation units described in Tables 1 and 2. Specifically, MIL-DTL-382D states to place a weighed portion of approximately 50 g of the sample on the top sieve of a nest of sieves assembled as specified in Table 2 and provide with a bottom pan. Cover and shake for 30 minutes in a mechanical shaker geared to produce 300±15 gyrations and 150±10 taps of the striker per minute. Weigh the portions retained by each sieve and calculate to a percentage as required.

The perchlorate-free green flare compositions of the present disclosure include from approximately 0 (0%) to approximately 5 percent (5%) of sub-micron amorphous boron fuel, from approximately 0 (0%) to approximately 10 percent (10%) of powdered copper fuel, from approximately fifty percent (50%) to approximately sixty-five (65%) percent of barium nitrate oxidizer, mass fractions of barium nitrate oxidizer, approximately six percent (6%) to approximately twelve percent (12%) of polyvinyl chloride color enhancer, and approximately four percent (4%) to approximately seven point five percent (7.5%) of a two-part curable binder system including Epon™ Resin 813 epoxy and Versamid® 140 curing agent. Epon™ Resin 813 is a low viscosity liquid bisphenol-A based epoxy resin diluted with cresyl glycidyl ether. Epon™ Resin 813 is available through Hexion Speciality Chemicals of Houston, Tex. (www.hexion.com). Versamid® 140 is a medium low viscosity reactive polyamide resin based on dimerized fatty acid and polyamindes. Versamid® 140 is available through Cognis of Cincinnati, Ohio (www.cognis-.com). These compositions may be originally studied at laboratory scale, and are then scaled to the same 24-gram flare form factor. These compositions are then subjected to flare performance testing.

Figure 2:
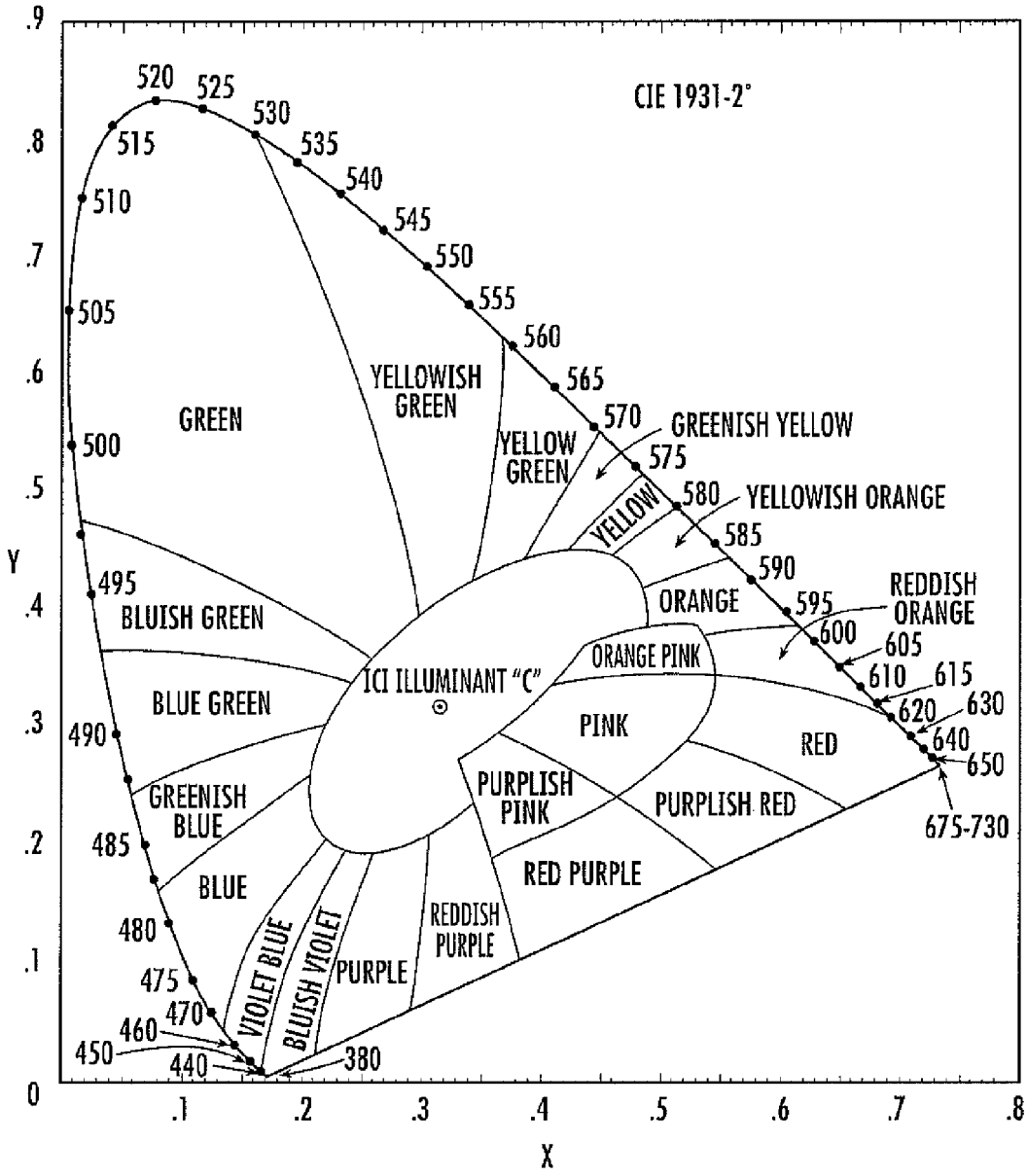
FIG. 2 is a representation of a Chromaticity Diagram.

During these tests, the luminous intensities are measured with a candlepower (also known as candelas (cd)) meter, and a Tri-Stimulus calorimeter may be used to obtain X-bar, Y-bar and Z-bar color coordinates from which the dominant wavelength and the color purity may be obtained using the well-known Chromaticity Diagram as illustrated in FIG. 2. Each of the three calorimeters in this device is filtered so that it records the emission intensity of the flare versus time in one of three spectral regions in the visible spectrum. The X-bar, Y-bar and Z-bar coordinates are obtained when the ratios of the integrated intensity from each calorimeter is divided by the total intensity from all three calorimeters. The X-bar and Y-bar coordinates are then located on the Chromaticity Diagram and a straight line is drawn through that point and the "white light" point at approximately X-bar=0.310, Y-bar=0.316. The dominant wavelength is found at the point this line intersects with the nearest axis of the Chromaticity Diagram. The color purity is calculated as the percentage corresponding to the fraction that is formed by dividing the distance between the white light point and the measured X,Y point by the distance between the white light point and the intersection of the line with the axis of the Chromaticity Diagram.

In these tests the luminous intensities of the perchlorate-free green flare compositions of the present disclosure substantially exceeded those of the in-service perchlorate-containing IS G green flare that is used as a comparison standard. With these higher intensities the perchlorate-free compositions of the present disclosure may beneficially increase the burn time of the green signal flares while still meeting all flare performance specifications for luminous intensity, dominant wavelength and color purity. A longer and brighter burning signal such as this should beneficially increase the likelihood that a signal being burned could be spotted.

The green formulation embodiments that are investigated and found to exhibit adequate performance are listed in Table 3. All of the digital photographs obtained during the burn of these compositions showed vivid green colors. None of the perchlorate-free compositions in Table 3 produced a significantly "washed out" green flame when compared with the IS G perchlorate-containing standard composition. In general these four perchlorate-free compositions are successful in equaling or exceeding the performance of the in-service perchlorate-containing IS G. The results of the performance tests of these compositions are summarized in Table 4. This data is obtained from 15-gram laboratory scale flare candles. It is noted that the burn rate and the Candle Power luminous intensity increased as the specific surface area of the magnesium fuel increased with the progressively higher weight percentages of the smaller particle Granulation 15 magnesium fuel. The values of the dominant wavelengths and color purities were reasonably similar, and were all within performance specifications for the standard green composition.

Table 3 is included to show representative embodiments of the perchlorate-free GSF-1E type compositions. Similarly, Table 4 provides the flare performance test results of representative embodiments of the GSF-1E green flare.

TABLE 3

Standard and Perchlorate-Free Green Signal Flare Compositions Tested

| | IS G Std | GSF-1E1 | GSF-1E2 | GSF-1E3 | GSF-1E4 |
|---|---|---|---|---|---|
| Chemical | (Wt %) | (Wt %) | (Wt %) | (Wt %) | (Wt %) |
| Boron | 0 | 2.85 | 2.85 | 2.85 | 2.85 |
| Mg (GR 18) | 21.00 | 9.81 | 7.35 | 4.89 | 0 |
| Mg (GR 15) | 0 | 4.89 | 7.35 | 9.81 | 14.70 |
| Copper | 7.00 | 6.70 | 6.70 | 6.70 | 6.70 |
| $Mg_{0.5}Al_{0.5}$ | 0 | 0 | 0 | 0 | 0 |
| $KClO_4$ | 32.50 | 0 | 0 | 0 | 0 |
| $Ba(NO_3)_2$ | 22.50 | 62.75 | 62.75 | 62.75 | 62.75 |
| PVC | 12.00 | 8.00 | 8.00 | 8.00 | 8.00 |
| Epon 813 | 3.50 | 3.50 | 3.50 | 3.50 | 3.50 |
| Versamid 140 | 1.50 | 1.50 | 1.50 | 1.50 | 1.50 |

TABLE 4

Summary of Averaged Perchlorate-Free Green Flare Performance Test Data

| Composition | Magnesium Granulation | Luminous Intensity, cd | % Color Purity | Dominant Wavelength, nm | Burn Time, s |
|---|---|---|---|---|---|
| GSF-1E1 | 33% GR 15 + 67% GR 18 | 763 | 54 | 547 | 31 |
| GSF-1E2 | 50% GR 15 + 50% GR 18 | 794 | 55 | 547 | 27 |
| GSF-1E3 | 67% GR 15 + 33% GR 18 | 1113 | 56 | 546 | 21 |
| GSF-1E4 | 100% GR 15 | 1587 | 52 | 550 | 17 |
| IS G STD | 100% GR 18 | 526 | 48 | 544 | 30 |

As shown in Table 4, the in-service flares on average burned in approximately 30 seconds. It is noted from Table 4 that the perchlorate-free GSF-1E1 composition had a very similar burn time as the in-service IS G standard composition, together with a beneficially higher luminous intensity. This GSF-1E1 composition provides a perchlorate-free product improvement over the green flare in the in-service perchlorate-containing IS G. However, other embodiments shown in Table 4 may also be useful in other green signal flare devices.

Tailoring of the burn time of these perchlorate-free green flares can be accomplished by changes in the magnesium particle size granulation. For example, the perchlorate-free compositions of the present disclosure provided a range of burn time from approximately 17 to approximately 31 seconds. For example, as shown in Table 4, the 100% GR 15 magnesium particle size granulation provided a burn time of approximately 17 seconds. As shown in Table 4, the perchlorate-free compositions of the present disclosure included a 33% GR 15 and a 67% GR 18 magnesium particle size granulation which provided a burn time of approximately 31 seconds.

It is also postulated that tailoring the burn time can be accomplished by variation of the fuel to oxidizer (F/O) ratio of the composition and variation of the weight percentage of the epoxy binder system. From the trends exhibited in Table 4, the burn time of the flare candle can readily be tailored over a fairly wide range.

Figure 3:
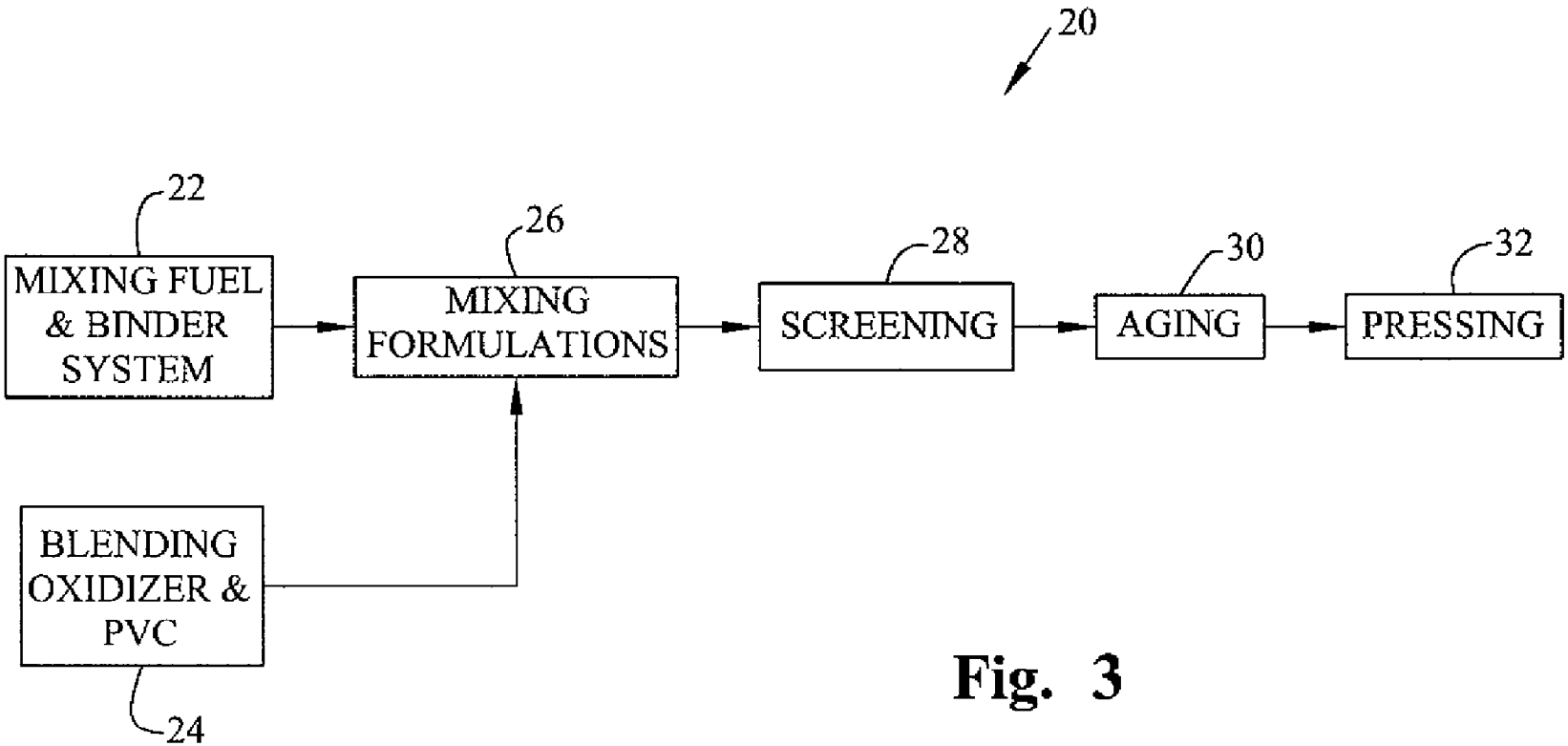
FIG. 3 is a schematic illustration of a flow chart illustrative of preparing the signal flare composition.

As shown in FIG. 3, an illustrative manufacturing process 20 includes the step of mixing 22 magnesium, amorphous boron, and copper with the two-part curable binder system. In one embodiment, the sides of the mixing bowl are wiped with a non-sparking spatula during the course of the mixing process of step 22. For example, the three fuels: magnesium, amorphous boron, and copper, and the two-part curable binder system are mixed for five minutes (5 min). This action may be followed by wiping the sides of the mixing bowl with a non-sparking spatula. The substeps of mixing and wiping may be repeated two (2) to approximately four (4) times.

Manufacturing process 20 also includes the step of blending 24 barium nitrate and polyvinyl chloride. In one embodiment, barium nitrate and polyvinyl chloride are placed on either a Standard No. 16 or No. 30 sieve. With a cotton mitt, barium nitrate and polyvinyl chloride are hand worked through the sieve onto a bottom pan. This action may be repeated approximately three (3) times.

The next step of manufacturing process 20 includes mixing 26 portions of mix 22 with portions of mix 24. In one embodiment, the sides of the mixing bowl are wiped with a non-sparking spatula during the course of the mixing process of step 26. For example, portions of mix 22 and mix 24 are mixed for five minutes (5 min). This action may be followed by wiping the sides of the mixing bowl with a non-sparking spatula. The substeps of mixing and wiping may be repeated two (2) to approximately four (4) times.

Manufacturing process 20 includes the steps of screening 28 and aging 30 composition 16 for a period of time. In one embodiment, composition 16 is batched in five hundred grams (500 g) units for overnight aging 30. Finally, manufacturing process 20 includes the steps of pressing 32 composition 16.

This improved performance results from certain beneficial changes in the manufacturing process:

As illustrated in step 26, composition 16 is mixed for longer periods of time after adding the pre-mixed barium nitrate and polyvinyl chloride ingredients to the binder coated magnesium fuel. In one embodiment, the sides of the mixing bowl are wiped with a non-sparking spatula during the course of the mixing process of step 26. For example, composition 16 is mixed for five minutes (5 min). This action may be followed by wiping the sides of the mixing bowl with a non-sparking spatula. The substeps of mixing and wiping may be repeated two (2) to approximately four (4) times. This leads to a more homogeneous mixture and seems to be an illustrative change in terms of improved performance.

As illustrated in step 28 of FIG. 3, composition 16 is screened 28 through a Standard No. 16 sieve after mixing step 26, and prior to press consolidation step 32. In this illustrative embodiment, the sieve serves to remove from mixture 16 any clumps larger than approximately 0.9 millimeter which would be expected to be binder rich and would lead to a less homogeneous mixture if the larger clumps are included.

Composition 16 is allowed to age 30 for at least approximately three to approximately four hours after being mixed 26 and before being press consolidated 32 into flare candles 10. Compositions 16 are pressed 32 and allowed to age 30 overnight and are found to still be an uncured state and in a readily pressable condition. It is likely that this aging step 30 permits any heat and/or gaseous products that are liberated when the two binder components are mixed 26 to be dissipated prior to the press consolidation step.

The press consolidation 32 pressure is increased from approximately eight thousand pounds (8,000 lbs) dead load to approximately nine thousand pounds (9,000 lbs) dead load.

An advantage over the earlier versions of these green signal flares is that compositions 16 do not include environmentally objectionable perchlorate ingredients. All of these colored flares give comparable or somewhat improved performance including their general appearance, candlepower luminous intensity, burn time, dominant wavelength, and color purity. This should ensure that these perchlorate-free colored signal flare compositions continue to meet or exceed all of the performance parameters included in the flare performance specifications for the green signal flares.

Another advantage is that elimination of the perchlorate oxidizer from these green compositions is determined not to have significantly increased the ignition sensitivity of these compositions to impact, rotary friction or electrostatic stimuli. This reduces the potential for an accidental initiation of a signal flare. Table 5 is included to compare the measured ignition sensitivities of the in-service and perchlorate-free colored signal flare compositions, as well as to explain the classification criteria used during this sensitivity testing. It is noted that excessively high ignition sensitivity can often be mitigated by substituting coarser fuel particles, as well as by either increasing the binder percentage of the composition, or by carrying out a separate binder pre-coating step of electrostatic and friction sensitive fine particle fuels. Accordingly, it is observed that the friction sensitivity of the compositions including 7% of epoxy binder is beneficially improved when compared to the corresponding friction sensitivities of the compositions with 5% and 6% of epoxy binder. It is noted that this strategy of increasing binder content is also effective in increasing the burn time of the signal flares.

TABLE 5

Ignition Sensitivities of In-Service and Perchlorate-Free Signal Flare Compositions

| | Impact Sensitivity | | Friction Sensitivity | | Electrostatic Sensitivity | |
|---|---|---|---|---|---|---|
| | 50% fire | | Energy (ft-lb) | | | Maximum No Fire |
| Sample | Height (cm) | Energy (J) | Average | Lowest | Response | Energy (Joules |
| IS G Green Standard | 91.01 | 17.84 | 103.49 | 29.67 | 100% Fired | 0.250 |
| GSF-1E | 133.72 | 26.21 | 1134.26 | 199.42 | 80% Fired | 0.180 |

Classification Criteria

The following table represents the energy levels required to classify a material with respect to its sensitivity to various forms of external energy input.

| Sensitivity Level | Impact height (cm) | 50% fire energy (Joule) | Friction (Foot-pound) | Electrostatic (Joule) |
|---|---|---|---|---|
| Dangerous | <10 | <1.96 | <30 | <0.01 |
| High | <32 | <6.27 | <100 | <1.0 |
| Moderate | <100 | <19.6 | <500 | <10.0 |
| Low | <159 | <31.16 | <1000 | <25.0 |
| Very Low | <50% fires at 159 cm/31.16 Joule | | >1000 | >25.0 |
| Non-reactive | No energetic reactions observed at upper limit of apparatus being used. | | | |

Some alternatives in the composition of the present disclosure have been alluded to above and should be obvious to one skilled in the art. For example, the ingredient percentages may be modified in order to tailor the burn rate and cause the signal flares to burn for a longer or shorter time. The percentage and the particle size granulation of metallic fuels may also be modified in order to make the composition more or less sensitive to accidental initiation by impact, rotary friction, or electrostatic stimuli, as well as to tailor its burn rate. The choice of the binder system as well as its weight percentage in the composition is also known by one skilled in the art to affect both the ignition sensitivity and the burn rate of the signal flare compositions.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A flare composition for producing a green flame, the composition comprising, by weight, a magnesium fuel within the range of approximately ten percent (10%) to approximately thirty percent (30%) of the composition, the magnesium fuel including particles sizes selected from the group consisting of granulation 15, granulation 17, granulation 18, and mixtures thereof, a sub-micron amorphous boron fuel making up to approximately five percent (5%) of the composition, a powdered copper fuel making up to approximately ten percent (10%) of the composition, a barium nitrate oxidizer within the range of approximately fifty percent (50%) to approximately sixty-five percent (65%) of the composition, a polyvinyl chloride color enhancer within the range of approximately six percent (6%) to approximately twelve percent (12%) of the composition, and a two-part curable binder system within the range of approximately four percent (4%) to approximately seven point five percent (7.5%) of the composition, the binder system including the range of approximately seventy percent (70%) to approximately eighty percent (80%) epoxy and within the range of approximately twenty percent (20%) to approximately thirty percent (30%) curing agent.

2. The composition of claim 1, wherein the magnesium fuel at granulation 18 particle size is approximately ten weight percent (10%) of the composition.

3. The composition of claim 2, wherein the magnesium fuel at granulation 15 particle size is approximately five weight percent (5%) of the composition.

4. The composition of claim 1, wherein the powdered copper fuel is approximately seven weight percent (7%) of the composition.

5. The composition of claim 1, wherein the barium nitrate oxidizer is approximately sixty-three weight percent (63%) of the composition.

6. The composition of claim 1, wherein the polyvinyl chloride color enhancer is approximately eight weight percent (8%) of the composition.

7. The composition of claim 1, wherein the binder system is approximately five weight percent (5%) of the composition.

8. The composition of claim 1, wherein the epoxy is approximately three point five weight percent (3.5%) of the composition.

9. The composition of claim 1, wherein the curing agent is approximately one point five weight percent (1.5%) of the composition.

10. The composition of claim 1, wherein the curing agent includes polyamide resin.

11. The composition of claim 10, wherein the polyamide resin includes a reactive polyamide resin derived from dimerized fatty acid and polyamindes.

12. The composition of claim 1, wherein the composition excludes perchlorate.

13. The composition of claim 1, wherein the composition excludes calcium nitrate.

14. A method of producing a flare composition, the method comprising the steps of:

mixing magnesium within the range of approximately ten weight percent (10%) to approximately thirty weight percent (30%) of the composition, amorphous boron making up to approximately five weight percent (5%) of the composition, copper making up to approximately ten weight percent (10%) of the composition, and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof, wherein the binder system includes the range of approximately seventy percent (70%) to approximately eighty percent (80%) epoxy and within the range of approximately twenty percent (20%) to approximately thirty percent (30%) curing agent, blending barium nitrate within the range of approximately fifty percent (50%) to approximately sixty-five weight percent (65%) of the composition and polyvinyl chloride within the range of approximately six weight percent (6%) to approximately twelve weight percent (12%) of the composition, mixing the barium nitrate and polyvinyl chloride mixture to the binder system coated magnesium, boron, and copper mixture in a mixing bowl to provide the composition, wiping the sides of the mixing bowl, screening the composition, aging the composition for a period of time, and pressing the composition into the flare composition.

15. The method of claim 14 wherein the period of time is at least approximately three hours.

16. The method of claim 14 wherein the step of pressing the composition includes a press consolidation pressure of at least approximately eight thousand (8,000 lbs) pounds dead load.

17. The method of claim 16 wherein the press consolidation pressure is at least approximately nine thousand (9,000 lbs) pounds dead load.

18. The method of claim 14, wherein the composition excludes perchlorate and calcium nitrate.

19. The method of claim 14 wherein the wiping step includes wiping the sides of the mixing bowl with a non-sparking spatula.

20. The method of claim 14 wherein the screening step includes screening the composition through a Standard No. 16 sieve.

* * * * *